US009528176B2

(12) United States Patent
Mizuno et al.

(10) Patent No.: US 9,528,176 B2
(45) Date of Patent: Dec. 27, 2016

(54) THERMAL SPRAY POWDER AND FILM THAT CONTAIN RARE-EARTH ELEMENT, AND MEMBER PROVIDED WITH FILM

(71) Applicants: Hiroaki Mizuno, Kiyosu (JP); Junya Kitamura, Kiyosu (JP); Yoshiyuki Kobayashi, Miyagi-ken (JP)

(72) Inventors: Hiroaki Mizuno, Kiyosu (JP); Junya Kitamura, Kiyosu (JP); Yoshiyuki Kobayashi, Miyagi-ken (JP)

(73) Assignees: FUJIMI INCORPORATED, Kiyosu-Shi (JP); TOKYO ELECTRON LIMITED, Tokyo (JP)

( * ) Notice: Subject to any disclaimer, the term of this patent is extended or adjusted under 35 U.S.C. 154(b) by 0 days.

(21) Appl. No.: 14/346,583

(22) PCT Filed: Sep. 26, 2012

(86) PCT No.: PCT/JP2012/074718

§ 371 (c)(1),
(2) Date: Mar. 21, 2014

(87) PCT Pub. No.: WO2013/047588

PCT Pub. Date: Apr. 4, 2013

(65) Prior Publication Data

US 2014/0234634 A1 Aug. 21, 2014

(30) Foreign Application Priority Data

Sep. 26, 2011 (JP) ..... 2011-209564

(51) Int. Cl.

| | |
|---|---|
| ***C23C 4/10*** | (2016.01) |
| ***C23C 4/04*** | (2006.01) |
| ***C23C 4/06*** | (2016.01) |
| ***C23C 4/08*** | (2016.01) |

(52) U.S. Cl.

CPC ..... *C23C 4/105* (2013.01); *C23C 4/04* (2013.01); *C23C 4/06* (2013.01); *C23C 4/08* (2013.01); *C23C 4/11* (2016.01)

(58) Field of Classification Search

None

See application file for complete search history.

(56) References Cited

U.S. PATENT DOCUMENTS

| | | | | |
|---|---|---|---|---|
| 4,542,111 | A | 9/1985 | Buran et al. | |
| 4,751,099 | A | 6/1988 | Niino et al. | |
| 6,194,083 | B1 * | 2/2001 | Yasuda et al. | 428/615 |
| 6,602,814 | B1 | 8/2003 | Gadow et al. | |
| 2002/0160189 | A1 | 10/2002 | Wataya et al. | |
| 2004/0033884 | A1 | 2/2004 | Wallar | |
| 2007/0049484 | A1 | 3/2007 | Kear et al. | |
| 2007/0068798 | A1 * | 3/2007 | Honda et al. | 204/194 |
| 2010/0136349 | A1 * | 6/2010 | Lee | 428/446 |
| 2010/0272982 | A1 | 10/2010 | Dickinson et al. | |
| 2014/0234653 | A1 * | 8/2014 | Mizuno et al. | 428/649 |

FOREIGN PATENT DOCUMENTS

| | | | |
|---|---|---|---|
| JP | 11-264084 | A | 9/1999 |
| JP | 2008-133528 | A | 6/2008 |
| JP | 2010-535288 | A | 11/2010 |
| WO | WO-2009/017766 | A1 | 2/2009 |
| WO | WO 2010/053687 | A2 | 5/2010 |

OTHER PUBLICATIONS

JP 11-264084 Sep. 28, 1999. MT.*

US Non-Final Office Action dated Aug. 27, 2015 issued in U.S. Appl. No. 14/346,553.

US Non-Final Office Action dated Aug. 22, 2014 issued in U.S. Appl. No. 14/346,553.

US Final Office Action dated Mar. 13, 2015 issued in U.S. Appl. No. 14/346,553.

Mizuno: US Office Action on U.S. Appl. No. 14/346,553 dated Apr. 21, 2016.

Mizuno: US Office Action on U.S. Appl. No. 14/346,553 dated Sep. 28, 2016.

* cited by examiner

*Primary Examiner* — Vera Katz

(74) *Attorney, Agent, or Firm* — Foley & Lardner LLP

(57) ABSTRACT

A thermal spray powder of the present invention contains a rare earth element and a diluent element that is not a rare earth element or oxygen, which is at least one element selected, for example, from zinc, silicon, boron, phosphorus, titanium, calcium, strontium, and magnesium. A sintered body of a single oxide of the diluent element has an erosion rate under specific etching conditions that is no less than 5 times the erosion rate of an yttrium oxide sintered body under the same etching conditions.

9 Claims, No Drawings

THERMAL SPRAY POWDER AND FILM THAT CONTAIN RARE-EARTH ELEMENT, AND MEMBER PROVIDED WITH FILM

TECHNICAL FIELD

The present invention relates to a thermal spray powder containing a rare earth element. The present invention also relates to a coating containing a rare earth element and a member including the coating.

BACKGROUND ART

In the field of semiconductor device manufacturing, microfabrication of a semiconductor substrate, such as a silicon wafer, is performed at times by plasma etching, which is one type of dry etching. During this etching process, a member inside a semiconductor device manufacturing apparatus that is exposed to reactive plasma may be subject to erosion (damage) and generate particles. Deposition of the generated particles on the semiconductor substrate may make it difficult to perform microfabrication as designed or cause contamination of the semiconductor substrate by elements contained in the particles. A thermal spray coating containing a rare earth element is therefore conventionally provided on a member exposed to reactive plasma during the etching process to protect the member from plasma erosion (see, for example, Patent Document 1).

However, even with a thermal spray coating containing a rare earth element, the generation of particles cannot be suppressed completely. In order to minimize the detrimental effects due to particles as much as possible, it is important first of all to reduce the number of particles deposited on the semiconductor substrate, and for this purpose, it is effective to reduce the size of particles generated when a thermal spray coating is subject to plasma erosion. This is because particles of small size are readily subject to erosion by the reactive plasma while being suspended in the etching process and eventually made to disappear by being gasified or are readily discharged to the exterior by being carried by a gas flow inside the semiconductor device manufacturing apparatus and are thereby prevented from depositing on the semiconductor substrate.

PRIOR ART DOCUMENTS

Patent Document 1: Japanese Laid-Open Patent Publication No. 2008-133528

SUMMARY OF THE INVENTION

Problems that the Invention is to Solve

Therefore, it is an objective of the present invention to provide a thermal spray powder suited for forming a thermal spray coating that is less likely to generate particles of large size when subject to plasma erosion. Also, another objective of the present invention is to provide a coating that is less likely to generate particles of large size when subject to plasma erosion and a member that includes the coating on its surface.

Means for Solving the Problems

In order to achieve the above objectives and in accordance with a first aspect of the present invention, a thermal spray powder is provided that contains a rare earth element and a first diluent element that is not a rare earth element or oxygen. The rare earth element and the first diluent element are contained in the thermal spray powder, for example, in the form of oxides. Under etching conditions of applying high frequency power of 1,300 W and 13.56 MHz for 20 hours while supplying an etching gas that is a 95:950:10 volume ratio mixture of carbon tetrafluoride, argon, and oxygen at a flow rate of 1.055 L/minute inside a chamber of a parallel plate plasma etching apparatus maintained at a pressure of 133.3 Pa, a sintered body of a single oxide of the first diluent element has an erosion rate of no less than 5 times the erosion rate of an yttrium oxide sintered body under the same etching conditions. The first diluent element is, for example, at least one element selected from the group consisting of zinc, silicon, boron, phosphorus, titanium, calcium, strontium, barium, and magnesium. The thermal spray powder may further contain, for example in the form of an oxide, a second diluent element that is not a rare earth element or the first diluent element and is not oxygen. A sintered body of a single oxide of the second diluent element has an erosion rate under the above etching conditions that is no less than 1.5 times and less than 5 times the erosion rate of an yttrium oxide sintered body under the same etching conditions. The second diluent element is, for example, at least one element selected from the group consisting of aluminum, zirconium, hafnium, niobium, and tantalum.

In accordance with a second aspect of the present invention, a coating obtained by thermal spraying the thermal spray powder according to the first aspect is provided.

In accordance with a third aspect of the present invention, a coating containing a rare earth element and a first diluent element that is not a rare earth element or oxygen. A sintered body of a single oxide of the first diluent element has an erosion rate under the above etching conditions that is no less than 5 times the erosion rate of an yttrium oxide sintered body under the same etching conditions. The coating may further contain a second diluent element that is not a rare earth element or the first diluent element and is not oxygen. A sintered body of a single oxide of the second diluent element has an erosion rate under the above etching conditions that is no less than 1.5 times and less than 5 times the erosion rate of an yttrium oxide sintered body under the same etching conditions.

In accordance with a fourth aspect of the present invention, a member including the coating according to the second or third aspect on its surface is provided.

Effects of the Invention

The present invention succeeds in providing a thermal spray powder suited for forming a thermal spray coating that is less likely to generate particles of large size when subject to plasma erosion. Also, the present invention succeeds in providing a coating that is less likely to generate particles of large size when subject to plasma erosion and a member that includes the coating on its surface.

MODES FOR CARRYING OUT THE INVENTION

One embodiment of the present invention will now be described. The present invention is not restricted to the embodiment described below and modifications may be made as suited within a range that does not impair the effects of the present invention.

A thermal spray powder according to the embodiment contains a rare earth element and a first diluent element that is not a rare earth element or oxygen. The first diluent element is used for the purpose of decreasing the ratio of the rare earth element content in the thermal spray powder and in a coating obtained by thermal spraying the thermal spray powder.

Rare earth elements are, specifically, scandium (element symbol: Sc), yttrium (element symbol: Y), lanthanum (element symbol: La), cerium (element symbol: Ce), praseodymium (element symbol: Pr), neodymium (element symbol: Nd), promethium (element symbol: Pm), samarium (element symbol: Sm), europium (element symbol: Eu), gadolinium (element symbol: Gd), terbium (element symbol: Tb), dysprosium (element symbol: Dy), holmium (element symbol: Ho), erbium (element symbol: Er), thulium (element symbol: Tm), ytterbium (element symbol: Yb), and lutetium (element symbol: Lu). Among these, Sc, Y, La, Ce, Pr, Nd, Sm, Gd, Dy, Er, and Yb, and especially Sc, Y, La, Ce, and Nd, which are present relatively abundantly in the earth's crust, are favorable.

Examples of the first diluent element include zinc (element symbol: Zn), silicon (element symbol: Si), boron (element symbol: B), phosphorus (element symbol: P), titanium (element symbol: Ti), calcium (element symbol: Ca), strontium (element symbol: Sr), barium (element symbol: Ba), and magnesium (element symbol: Mg). Under specific etching conditions described below, a sintered body of any of ZnO, $SiO_2$, $B_2O_3$, $P_2O_5$, $TiO_2$, CaO, SrO, BaO, and MgO, which are the oxides of the above elements, has an erosion rate (that is, an erosion amount per unit time) of no less than 5 times the erosion rate of an yttrium oxide ($Y_2O_3$) sintered body under the same etching conditions. The specific etching conditions are that high frequency power of 1,300 W and 13.56 MHz is applied for 20 hours while supplying an etching gas that is a 95:950:10 volume ratio mixture of carbon tetrafluoride ($CF_4$), argon, and oxygen at a flow rate of 1.055 L/minute (1,055 sccm) inside a chamber of a parallel plate plasma etching apparatus maintained at a pressure of 133.3 Pa (1,000 mTorr).

The content of a rare earth element in the thermal spray powder is preferably 20% by mol or more, more preferably 25% by mol or more, even more preferably 30% by mol or more, and especially preferably 35% by mol or more in terms of oxide. Rare earth element compounds, such as rare earth element oxides, are high in chemical stability and excellent in plasma erosion resistance. Therefore, as the rare earth element content in the thermal spray powder increases, the plasma erosion resistance of a coating obtained by thermal spraying the thermal spray powder tends to improve.

The content of a rare earth element in the thermal spray powder is also preferably 90% by mol or less, more preferably 80% by mol or less, even more preferably 70% by mol or less, and especially preferably 60% by mol or less in terms of oxide. Rare earth elements are expensive and unstable in supply due to the uneven distribution of production sites. Accordingly, as the rare earth element content in the thermal spray powder decreases, there is an advantage of reduction in risk related to the supply of raw material of the thermal spray powder.

The content of the first diluent element in the thermal spray powder is preferably 5% by mol or more, more preferably 10% by mol or more, even more preferably 15% by mol or more, and especially preferably 20% by mol or more in terms of oxide. As the first diluent element content in the thermal spray powder increases, the size of particles is reduced that are generated when a coating obtained by thermal spraying the thermal spray powder is subject to plasma erosion. The reason for this is considered to be that since compounds of the first diluent element are lower in plasma erosion resistance than rare earth element compounds, weak points that are readily attacked by plasma are present in a dispersed manner in the coating due to the addition of the first diluent element thereto. On the other hand, if such weak points are not dispersed in the coating, attack by plasma is concentrated at the few weak points in the coating and consequently, particles of large size may be generated.

The content of the first diluent element in the thermal spray powder is also preferably 60% by mol or less, more preferably 50% by mol or less, even more preferably 40% by mol or less, and especially preferably 30% by mol or less in terms of oxide. As mentioned above, compounds of the first diluent element are relatively low in plasma erosion resistance. Therefore, as the first diluent element content in the thermal spray powder decreases, the plasma erosion resistance of a coating obtained by thermal spraying the thermal spray powder tends to improve.

The thermal spray powder may further contain a second diluent element that is not a rare earth element or the first diluent element and is not oxygen. As with the first diluent element, the second diluent element is also used for the purpose of decreasing the ratio of the rare earth element content in the thermal spray powder and in a coating obtained by thermal spraying the thermal spray powder. Examples of the second diluent element include aluminum (element symbol: Al), zirconium (element symbol: Zr), hafnium (element symbol: Hf), niobium (element symbol: Nb), and tantalum (element symbol: Ta). Under the specific etching conditions described above, a sintered body of any of $Al_2O_3$, $ZrO_2$, $HfO_2$, $Nb_2O_5$, and $Ta_2O_5$, which are the oxides of the above elements, has an erosion rate of no less than 1.5 times and less than 5 times the erosion rate of an yttrium oxide sintered body under the same etching conditions.

The content of the second diluent element in the thermal spray powder is preferably 10% by mol or more, more preferably 15% by mol or more, even more preferably 20% by mol or more, and especially preferably 25% by mol or more in terms of oxide. As the second diluent element content in the thermal spray powder increases, the weak points in the coating are dispersed more appropriately by the actions of the second diluent element compound, the plasma erosion resistance of which is intermediate between those of the rare earth element compound and the first diluent element compound, and therefore, the size of the particles is further reduced that are generated when a coating obtained by thermal spraying the thermal spray powder is subject to plasma erosion.

The content of the second diluent element in the thermal spray powder is also preferably 70% by mol or less, more preferably 60% by mol or less, even more preferably 50% by mol or less, and especially preferably 40% by mol or less in terms of oxide. As the second diluent element content in the thermal spray powder decreases, the rare earth element content in the thermal spray powder relatively increases and the plasma erosion resistance of a coating obtained by thermal spraying the thermal spray powder tends to improve.

The thermal spray powder is formed, for example, from a mixture of a rare earth element compound and a compound of the first diluent element or from a compound or a solid solution containing a rare earth element and the first diluent element. A typical example of a rare earth element compound is a rare earth element oxide. A typical example of a compound of the first diluent element is an oxide of the element. A typical example of a compound or a solid solution containing a rare earth element and the first diluent element is a composite oxide of a rare earth element and the first diluent element. In the case where the thermal spray powder contains the second diluent element, the thermal spray powder is formed, for example, from a mixture of a rare earth element compound, a compound of the first diluent element, and a compound of the second diluent element or from a compound or a solid solution containing a rare earth element, the first diluent element, and the second diluent element.

The thermal spray powder is produced, for example, by mixing a powder made of a compound (for example, an oxide) of the first diluent element in a powder made of a rare earth element compound, such as a rare earth element oxide, and if necessary, further mixing in a powder made of a compound (for example, an oxide) of the second diluent element. Preferably, with a rare earth element compound powder used, particles having a particle diameter, as measured by a particle size distribution analyzer of a laser scattering and diffraction type, of 10 μm or less, and more specifically 6 μm or less, 3 μm or less, or 1 μm or less take up 90% by volume or more of the powder. By using a rare earth element compound powder of fine particle size, the size of particles can be reduced that are generated when a coating obtained by thermal spraying the thermal spray powder is subject to plasma erosion. The reason for this is considered to be that the rare earth element compound portions in the coating, which has the rare earth element compound portions and the group 2 element compound portions, are thereby reduced in size.

Alternatively, the thermal spray powder may be produced by granulating and sintering a raw material powder containing a powder of a compound or simple substance of a rare earth element and a powder of a compound or simple substance of the first diluent element, and further containing, if necessary, a powder of a compound or simple substance of the second diluent element. In this case, even if the rare earth element, the first diluent element, and the second diluent element are present in the raw material powder in forms other than their respective oxides, for example, in the form of their respective simple substances, hydroxides, or salts, it is possible to convert these to oxides in the sintering process.

In producing the thermal spray powder constituted of granulated and sintered particles obtained by granulation and sintering of the raw material powder, the granulation of the raw material powder may be performed by spray granulation of a slurry prepared by mixing the raw material powder in a suitable dispersion medium and adding a binder to the mixture as necessary or may be performed directly from the raw material powder by rolling granulation or compression granulation. The sintering of the raw material powder after granulation may be performed in air, in an oxygen atmosphere, in a vacuum, or in an inert gas atmosphere. However, to convert an element in the raw material powder that is present in forms other than an oxide to an oxide, it is preferable to perform the sintering in air or in an oxygen atmosphere. The sintering temperature is not restricted in particular and is preferably 1,000 to 1,700° C., more preferably 1,100 to 1,700° C., and even more preferably 1,200 to 1,700° C. The maximum temperature retention time during sintering is also not restricted in particular and is preferably 10 minutes to 24 hours, more preferably 30 minutes to 24 hours, and even more preferably 1 to 24 hours.

The thermal spray powder according to the embodiment is used for forming a coating on the surface of a member in a semiconductor device manufacturing apparatus or another member by a thermal spraying method, such as a plasma spraying method, a high-velocity flame spraying method, flame spraying method, detonation flame spraying method, and aerosol deposition method. In a coating obtained by thermal spraying the thermal spray powder containing a rare earth element and the first diluent element, the rare earth element and the first diluent element are contained in the form of compounds, such as oxides. In a coating obtained by thermal spraying the thermal spray powder containing a rare earth element, the first diluent element, and the second diluent element, the rare earth element, the first diluent element, and the second diluent element are contained in the form of compounds, such as oxides.

The size of the rare earth element compound portions in the thermal spray coating as observed from a reflection electron image obtained by a field emission scanning electron microscope is preferably 20 $\mu m^2$ or less, more preferably 2 $\mu m^2$ or less, even more preferably 0.2 $\mu m^2$ or less, and especially preferably 0.02 $\mu m^2$ or less. The size of particles generated from the thermal spray coating when it is subject to plasma erosion can be reduced as the rare earth element compound portions are reduced in size.

The thickness of the thermal spray coating is not restricted in particular and may, for example, be 30 to 1,000 μm. However, the thickness is preferably 50 to 500 μm and more preferably 80 to 300 μm.

The following effects and advantages are provided by the present embodiment.

- The thermal spray powder according to the present embodiment contains a rare earth element and the first diluent element that is not a rare earth element or oxygen. With a sintered body of a single oxide of the first diluent element, the erosion rate under the specific etching conditions is no less than 5 times the erosion rate of an yttrium oxide sintered body under the same etching conditions. The coating, containing the rare earth element and the first diluent element, that is obtained by thermal spraying the thermal spray powder thus has a high plasma erosion resistance as an effect of the rare earth element and has a property of being less likely to generate particles of large size as an effect of the first diluent element. That is, the present embodiment succeeds in providing a thermal spray powder suited for forming a thermal spray coating that is less likely to generate particles of large size when subject to plasma erosion. Also, the present invention succeeds in providing a coating that is less likely to generate particles of large size when subject to plasma erosion and a member that includes the coating on its surface.
- The thermal spray powder according to the present embodiment contains the first diluent element in addition to a rare earth element and, in some cases, further contains a second diluent element that is not a rare earth element or the first diluent element and is not oxygen. The generation of particles of large size can thus be suppressed even more favorably. Also, the amount of a rare earth element used, which is expensive and unstable in supply, can thus be suppressed and the risk related to the supply of raw material of the thermal spray powder can be reduced.

The embodiment may be modified as follows.

- The thermal spray powder according to the embodiment may contain two or more types or preferably three or more types of rare earth elements. That is, the thermal spray powder may contain two or more or preferably three or more elements selected from the group consisting of Sc, Y, La, Ce, Pr, Nd, Pm, Sm, Eu, Gd, Tb, Dy, Ho, Er, Tm, Yb, and Lu. In this case, when a thermal spray coating obtained by thermal spraying the thermal spray powder is subject to plasma erosion and generates particles, the rare earth element content in the particles is divided by type of the rare earth elements, thereby enabling reduction of the possibility of the content of each rare earth element in particles deposited on the semiconductor substrate to exceed an allowable level. The content of each rare earth element in the thermal spray powder is preferably 5% by mol or more, more preferably 10% by mol or more, and even more preferably 15% by mol or more in terms of oxide. The content of each rare earth element in the thermal spray powder is also preferably 50% by mol or less, more preferably 40% by mol or less, even more preferably 30% by mol or less, and especially preferably 25% by mol or less in terms of oxide.

The thermal spray powder according to the embodiment may contain two or more types or preferably three or more types of first diluent elements. For example, the thermal spray powder may contain two or more or preferably three or more elements selected from the group consisting of Zn, Si, B, P, Ti, Ca, Sr, Ba, and Mg. In this case, when a thermal spray coating obtained by thermal spraying the thermal spray powder is subject to plasma erosion and generates particles, the first diluent element content in the particles is divided by type of the first diluent elements, thereby enabling reduction of the possibility of the content of each first diluent element in particles deposited on the semiconductor substrate to exceed an allowable level. The content of each first diluent element in the thermal spray powder is preferably 2% by mol or more, more preferably 5% by mol or more, even more preferably 8% by mol or more, and especially preferably 10% by mol or more in terms of oxide. The content of each first diluent element in the thermal spray powder is also preferably 40% by mol or less, more preferably 30% by mol or less, even more preferably 20% by mol or less, and especially preferably 10% by mol or less in terms of oxide.

The thermal spray powder according to the embodiment may contain two or more types or preferably three or more types of second diluent elements. For example, the thermal spray powder may contain two or more or preferably three or more elements selected from the group consisting of Al, Zr, Hf, Nb, and Ta. In this case, when a thermal spray coating obtained by thermal spraying the thermal spray powder is subject to plasma erosion and generates particles, the second diluent element content in the particles is divided by type of the second diluent elements, thereby enabling reduction of the possibility of the content of each second diluent element in particles deposited on the semiconductor substrate to exceed an allowable level. The content of each second diluent element in the thermal spray powder is preferably 5% by mol or more, more preferably 7% by mol or more, even more preferably 10% by mol or more, and especially preferably 12% by mol or more in terms of oxide. Also, the content of each second diluent element in the thermal spray powder is preferably 50% by mol or less, more preferably 40% by mol or less, even more preferably 30% by mol or less, and especially preferably 20% by mol or less in terms of oxide.

The coating containing a rare earth element and the first diluent element or the coating containing a rare earth element, the first diluent element, and the second diluent element is not restricted to being formed by thermal spraying a thermal spray powder such as that of the embodiment and may be formed by a method other than thermal spraying, for example, a chemical vapor deposition (CVD) method or a physical vapor deposition (PVD) method. The thickness of a coating that contains a rare earth element and a group 2 element and is formed by a method other than thermal spraying may, for example, be 0.1 to 100 μm and is preferably 0.5 to 50 μm and more preferably 1 to 30 μm.

Next, the present invention will be described more specifically by way of examples and comparative examples.

Thermal spray powders of Examples 1 to 5 and Comparative Examples 1 and 2, each containing a rare earth element, and a thermal spray powder of Comparative Example 3, not containing a rare earth element, were prepared. Each of the thermal spray powders of Examples 1 and 3 to 5 was produced by mixing and then granulating and sintering at least a powder of a rare earth element oxide, a powder of an oxide of a first diluent element that is not a rare earth element or oxygen, and a powder of an oxide of a second diluent element that is not a rare earth element or first diluent elements and is not oxygen. The thermal spray powder of Example 2 was produced by mixing and then granulating and sintering powders of rare earth element oxides and a powder of an oxide of the first diluent element. The thermal spray powder of Comparative Example 1 was produced by granulating and sintering a powder of a rare earth element oxide. The thermal spray powder of Comparative Example 2 was produced by mixing and then granulating and sintering a powder of a rare earth element oxide and powders of oxides of the second diluent elements. The thermal spray powder of Comparative Example 3 was produced by mixing and then granulating and sintering powders of oxides of the first diluent elements and powders of oxides of the second diluent elements. The details of the respective thermal spray powders are as shown in Table 1.

The types of rare earth elements contained in the respective thermal spray powders are shown in the "Type of rare earth element" column of Table 1. The molar percentages of rare earth element oxides in the respective thermal spray powders are shown in the "Ratio of rare earth element oxide" column of Table 1 according to each type of rare earth element.

The types of the first diluent elements contained in the respective thermal spray powders are shown in the "Type of first diluent element" column of Table 1. The molar percentages of the first diluent element oxides in the respective thermal spray powders are shown in the "Ratio of first diluent element oxide" column of Table 1 according to each type of first diluent element.

The types of the second diluent elements contained in the respective thermal spray powders are shown in the "Type of second diluent element" column of Table 1. The molar percentages of the second diluent element oxides in the respective thermal spray powders are shown in the "Ratio of second diluent element oxide" column of Table 1 according to each type of second diluent element.

The respective thermal spray powders of Examples 1 to 5 and Comparative Examples 1 to 3 were atmospheric pressure plasma sprayed under the thermal spraying conditions shown in Table 2 to form thermal spray coatings of 200 μm thickness on the surfaces of Al alloy (A6061) plates of 20 mm×20 mm×2 mm dimensions that had been blasted with a brown alumina abrasive (A#40). The results of evaluating the plasma erosion resistances of the thermal spray coatings obtained are shown in the "Plasma erosion resistance" column of Table 1. Specifically, the surface of each thermal spray coating was first mirror-polished using colloidal silica with an average particle diameter of 0.06 μm and a portion of the polished surface of the thermal spray coating was masked with a polyimide tape. Each thermal spray coating was then plasma etched under conditions of applying high frequency power of 1,300 W and 13.56 MHz for 20 hours while supplying an etching gas that is a 95:950:10 volume ratio mixture of carbon tetrafluoride, argon, and oxygen at a flow rate of 1.055 L/minute inside a chamber of a parallel plate plasma etching apparatus maintained at a pressure of 133.3 Pa. Thereafter, the size of a step between the masked portion and the unmasked portion was measured using the step measuring apparatus, "Alphastep," available from KLA-Tencor Corporation and the measured step size was divided by the etching time to calculate the erosion rate. In the "Plasma erosion resistance" column, "good" means that the ratio of the erosion rate with respect to the erosion rate in the case of Comparative Example 1 was less than 1.5 and "poor" means that the ratio was 1.5 or more.

The respective thermal spray powders of Examples 1 to 5 and Comparative Examples 1 to 3 were atmospheric pressure plasma sprayed under the thermal spraying conditions shown in Table 2 to form thermal spray coatings of 200 μm thickness on the surfaces of focus rings that are each used by installing on a periphery of a silicon wafer. The results of evaluating the number of particles that were generated due to plasma erosion from the thermal spray coating on each focus ring and deposited on each silicon wafer are shown in the "Number of particles" column of Table 1. Specifically, the surface of the thermal spray coating on each focus ring was polished using sandpaper until the surface roughness Ra became 0.5 μm or less. Each focus ring was then set, together with a silicon wafer, inside a chamber of a parallel plate plasma etching apparatus, and while maintaining the pressure inside the chamber at 133.3 Pa, an etching gas that is a 95:950:10 volume ratio mixture of carbon tetrafluoride, argon, and oxygen was supplied into the chamber at a flow rate of 1.055 L/minute, and under this state, each silicon wafer was plasma etched under the condition of applying high frequency power of 1,300 W and 13.56 MHz for 20 hours. Thereafter, the number of particles that were generated due to plasma erosion from the thermal spray coating on each focus ring and deposited on each silicon wafer was measured. The difference between the numbers of particles on each silicon wafer counted using the particle counter, "Surfscan," available from KLA-Tencor Corporation, before and after plasma etching was deemed to be the number of particles that were generated from the thermal spray coating on each focus ring and deposited on the silicon wafer, and in the "Number of particles" column, "good" means that the ratio of the number of particles with respect to the number of particles in the case of Comparative Example 1 was less than 1.0 and "poor" means that the ratio was 1.0 or more.

The raw material supply risks, that is, the risks in acquisition of raw materials of the respective thermal spray powders are shown in the "Risk" column of Table 1. A "good" evaluation was made in the case where the percentage of rare earth element oxides contained in a thermal spray powder is 95% by mol or less and a "poor" evaluation was made when the percentage is greater than 95% by mol.

TABLE 1

| | Type of rare earth element | Ratio of rare earth element oxide [% by mol] | Type of first diluent element | Ratio of first diluent element oxide [% by mol] | Type of second diluent element | Ratio of second diluent element oxide [% by mol] | Plasma erosion resistance | Number of particles | Risk |
|---|---|---|---|---|---|---|---|---|---|
| Example 1 | Y | 41 | Sr | 6 | Zr | 10 | good | good | good |
| | | | Zn | 10 | Ar | 15 | | | |
| | | | Ti | 8 | | | | | |
| | | | Si | 10 | | | | | |
| Example 2 | Yb | 20 | Si | 25 | — | — | good | good | good |
| | La | 10 | | | | | | | |
| | Y | 20 | | | | | | | |
| | Sm | 10 | | | | | | | |
| | Ce | 15 | | | | | | | |
| Example 3 | Sc | 25 | Ba | 4 | Zr | 3 | good | good | good |
| | Gd | 25 | | | | | | | |
| | Nd | 20 | | | | | | | |
| | Pr | 13 | | | | | | | |
| | Ho | 10 | | | | | | | |
| Example 4 | Y | 18 | Sr | 7 | Zr | 25 | good | good | good |
| | | | | | Al | 20 | | | |
| | | | | | Ti | 10 | | | |
| | | | | | Zn | 10 | | | |
| | | | | | Si | 10 | | | |
| Example 5 | Y | 90 | Ca | 2 | Zr | 8 | good | good | good |
| Comparative Example 1 | Y | 100 | — | — | — | — | good | poor | poor |
| Comparative Example 2 | Y | 70 | — | — | Zr | 20 | good | poor | good |
| | | | | | Nb | 10 | | | |
| Comparative Example 3 | — | — | Zn | 20 | Zr | 30 | poor | poor | good |
| | | | Si | 20 | Al | 10 | | | |
| | | | Ti | 20 | | | | | |

TABLE 2

| |
|---|
| Thermal spraying equipment: "SG-100," made by Praxair, Inc. |
| Powder supplying equipment: "Model 1264," made by Praxair, Inc. |
| Ar gas pressure: 50 psi (0.34 MPa) |
| He gas pressure: 50 psi (0.34 MPa) |
| Voltage: 37.0 V |
| Current: 900 A |
| Thermal spraying distance: 120 mm |
| Thermal spray powder supplying rate: 20 g/minute |

The invention claimed is:

1. A coating obtained by thermal spraying a thermal spray powder, wherein the thermal spray powder contains a rare earth element and a first diluent element that is at least one element selected from the group consisting of zinc, silicon, boron, phosphorus, titanium, calcium, strontium, barium, and magnesium, the rare earth element is contained in the thermal spray powder in an amount of 20% by mol or more and 90% by mol or less in terms of oxide, the first diluent element is contained in the thermal spray powder in an amount of 5% by mol or more and 60% by mol or less in terms of oxide, the thermal spray powder comprises a rare earth element compound powder in which particles having a particle diameter of 10 μm or less, account for 90% by volume or more of the rare earth element compound powder, and the coating comprises rare earth element compound portions having a size of 20 $\mu m^2$ or less, the coating includes, in a dispersed manner, weak points that are readily attacked by plasma and derived from the first diluent element, and under etching conditions of applying high frequency power of 1,300 W and 13.56 MHz for 20 hours while supplying an etching gas that is a 95:950:10 volume ratio mixture of carbon tetrafluoride, argon, and oxygen at a flow rate of 1.055 L/minute inside a chamber of a parallel plate plasma etching apparatus maintained at a pressure of 133.3 Pa, a sintered body of a single oxide of the first diluent element has an erosion rate of no less than 5 times the erosion rate of an yttrium oxide sintered body under the same etching conditions.

2. The coating according to claim 1, further comprising a second diluent element that is not a rare earth element or the first diluent element and is not oxygen, wherein a sintered body of a single oxide of the second diluent element has an erosion rate under the etching conditions that is no less than 1.5 times and less than 5 times the erosion rate of an yttrium oxide sintered body under the same etching conditions.

3. A member comprising the coating according to claim 1 on its surface.

4. The member according to claim 3, wherein the thermal spray powder is produced by granulating and sintering a raw material powder containing the rare earth element and the first diluent element.

5. The coating according to claim 1, wherein the thermal spray powder is produced by granulating and sintering a raw material powder containing the rare earth element and the first diluent element.

6. A method of forming a coating, comprising:

preparing a thermal spray powder containing a rare earth element and a first diluent element that is at least one element selected from the group consisting of zinc, silicon, boron, phosphorus, titanium, calcium, strontium, barium, and magnesium, wherein the rare earth element is contained in the thermal spray powder in an amount of 20% by mol or more and 90% by mol or less in terms of oxide, the first diluent element is contained in the thermal spray powder in an amount of 5% by mol or more and 60% by mol or less in terms of oxide, the thermal spray powder comprises a rare earth element compound powder in which particles having a particle diameter 10 μm or less account for 90% by volume or more of the rare earth element compound powder, and under etching conditions of applying high frequency power of 1,300 W and 13.56 MHz for 20 hours while supplying an etching gas that is a 95:950:10 volume ratio mixture of carbon tetrafluoride, argon, and oxygen at a flow rate of 1.055 L/minute inside a chamber of a parallel plate plasma etching apparatus maintained at a pressure of 133.3 Pa, a sintered body of a single oxide of the first diluent element has an erosion rate of no less than 5 times the erosion rate of an yttrium oxide sintered body under the same etching conditions; and thermal spraying the thermal spray powder to obtain the coating, wherein the coating comprises rare earth element compound portions having a size of 20 $\mu m^2$ or less, and the coating includes, in a dispersed manner, weak points that are readily attacked by plasma and derived from the first diluent element.

7. The method according to claim 6, wherein the thermal spray powder is produced by granulating and sintering a raw material powder containing the rare earth element and the first diluent element.

8. A method of producing a member with a coating on its surface, comprising:

preparing a thermal spray powder containing a rare earth element and a first diluent element that is at least one element selected from the group consisting of zinc, silicon, boron, phosphorus, titanium, calcium, strontium, barium, and magnesium, wherein the rare earth element is contained in the thermal spray powder in an amount of 20% by mol or more and 90% by mol or less in terms of oxide, the first diluent element is contained in the thermal spray powder in an amount of 5% by mol or more and 60% by mol or less in terms of oxide, the thermal spray powder comprises a rare earth element compound powder in which particles having a particle diameter of 10 μm or less, account for 90% by volume or more of the rare earth element compound powder, and under etching conditions of applying high frequency power of 1,300 W and 13.56 MHz for 20 hours while supplying an etching gas that is a 95:950:10 volume ratio mixture of carbon tetrafluoride, argon, and oxygen at a flow rate of 1.055 L/minute inside a chamber of a parallel plate plasma etching apparatus maintained at a pressure of 133.3 Pa, a sintered body of a single oxide of the first diluent element has an erosion rate of no less than 5 times the erosion rate of an yttrium oxide sintered body under the same etching conditions; and thermal spraying the thermal spray powder onto a member to form a coating on a surface of the member, wherein the coating comprises rare earth element compound portions having a size of 20 $\mu m^2$ or less, and the coating includes, in a dispersed manner, weak points that are readily attacked by plasma and derived from the first diluent element.

9. The method according to claim 8, wherein the thermal spray powder is produced by granulating and sintering a raw material powder containing the rare earth element and the first diluent element.

* * * * *